US007920816B2

(12) United States Patent
Ishikawa et al.

(10) Patent No.: US 7,920,816 B2
(45) Date of Patent: Apr. 5, 2011

(54) DEVELOPER COLLECTION DEVICE AND IMAGE FORMING APPARATUS

(75) Inventors: Tadashi Ishikawa, Kanagawa (JP); Mihoko Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 35 days.

(21) Appl. No.: 12/554,556

(22) Filed: Sep. 4, 2009

(65) Prior Publication Data

US 2010/0247192 A1 Sep. 30, 2010

(30) Foreign Application Priority Data

Mar. 27, 2009 (JP) ..... P2009-080028

(51) Int. Cl.
*G03G 21/00* (2006.01)
*G03G 21/10* (2006.01)

(52) U.S. Cl. ..... 399/358; 399/257; 399/360

(58) Field of Classification Search ..... 399/257, 399/358–360
See application file for complete search history.

(56) References Cited

U.S. PATENT DOCUMENTS 5,933,690 A * 8/1999 Sugimoto et al. ..... 399/257
7,149,467 B2 * 12/2006 Stickler et al. ..... 399/358

FOREIGN PATENT DOCUMENTS

| | | |
|---|---|---|
| JP | 2000-081787 | 3/2000 |
| JP | 2003-084570 | 3/2003 |
| JP | 2004-045981 | 2/2004 |
| JP | 2005-091848 | 4/2005 |

* cited by examiner

*Primary Examiner* — Hoang Ngo
(74) *Attorney, Agent, or Firm* — Morgan, Lewis & Bockius LLP

(57) ABSTRACT

A developer collection device includes: a collection unit including: a collection container that contains a developer to be collected; an upstream connection part that is formed with an inlet port through which the developer flows in; and a collection conveying part that conveys the developer flown in through the inlet port toward the collection container; and a connection unit including: an upstream connection port that is connected to an upstream conveying path; a connection conveying part that conveys the developer flown in through the upstream connection port in a developer conveying direction; and a connection outlet port that is formed at a downstream end in the developer conveying direction, wherein the connection unit is configured to be movable between an extracted position and a retracted position.

5 Claims, 11 Drawing Sheets

VIIF

IXC
IXD
IXE
51
51a
51b
52
52a
52b
52c
52d
53
53a
54
56
56a
58
59
59a
61
61a
61b
61c
61d
62
63
43
X
Y
Z
(-X)
(-Y)
(-Z)

DEVELOPER COLLECTION DEVICE AND IMAGE FORMING APPARATUS

CROSS-REFERENCE TO RELATED APPLICATIONS

This application is based on and claims priority under 35 U.S.C. 119 from Japanese Patent Application No. 2009-080028 filed Mar. 27, 2009.

BACKGROUND

1. Technical Field

This invention relates to developer collection device and an image forming apparatus.

2. Related Art

There is known a technique for an image forming apparatus of an electrophotographic type such as copying machines and printers in which a developer remaining on the surface of an image carrier at the time of image formation and a residue such as a discharge product and a paper powder are collected and conveyed.

SUMMARY

According to an aspect of the invention, there is provided a developer collection device including: a collection unit that is supported by a first frame; and a connection unit that is supported by a second frame that is detachable from the first frame. The collection unit includes: a collection container that contains a developer to be collected; an upstream connection part that is formed with an inlet port through which the developer flows in; and a collection conveying part that conveys the developer flown in through the inlet port toward the collection container. The connection unit includes: an upstream connection port that is connected to an upstream conveying path; a connection conveying part that conveys the developer flown in through the upstream connection port in a developer conveying direction; and a connection outlet port that is formed at a downstream end in the developer conveying direction. The connection unit is configured to be movable between an extracted position, at which the connection unit is extracted from the second frame to enter the first frame to connect the connection conveying part with the upstream connection part for connecting the connection outlet port with the inlet port, and a retracted position, at which the connection unit is retracted into the second frame to separate the connection conveying part from the upstream connection part.

BRIEF DESCRIPTION OF THE DRAWINGS

The exemplary embodiments of the invention will be described in detail based on the following figures, wherein:

FIGS. 7A-7F are explanatory views of a connection unit of the exemplary embodiment, wherein: FIG. 7A is a plan view; FIG. 7B is a side view; FIG. 7C is an oblique view; FIG. 7D is a plan view in a state where a lid is removed from FIG. 7A; FIG. 7E is an enlarged view of a right end part of a pipe cover in a state where a connection pipe is removed in FIG. 7D; and FIG. 7F is a view seen from an arrow VIIF direction of FIG. 7E;

FIGS. 8A-8E are explanatory views of the connection unit of the exemplary embodiment, wherein: FIG. 8A is a plan view; FIG. 8B is a view seen from an arrow VIIIB direction of FIG. 8A; FIG. 8C is a sectional view of a VIIIC-VIIIC line of FIG. 8B; FIG. 8D is an oblique view; and FIG. 8E is a view seen from an arrow VIIIE direction of FIG. 8D;

FIGS. 9A-9E are explanatory views of a linking component of the exemplary embodiment, wherein: FIG. 9A is an oblique view; FIG. 9B is a side view; FIG. 9C is a view seen from an arrow IXC direction of FIG. 9B; FIG. 9D is a view seen from an arrow IXD direction of FIG. 9B; and FIG. 9E is a sectional view of a IXE-IXE line of FIG. 9C;

DETAILED DESCRIPTION

Figure 1:
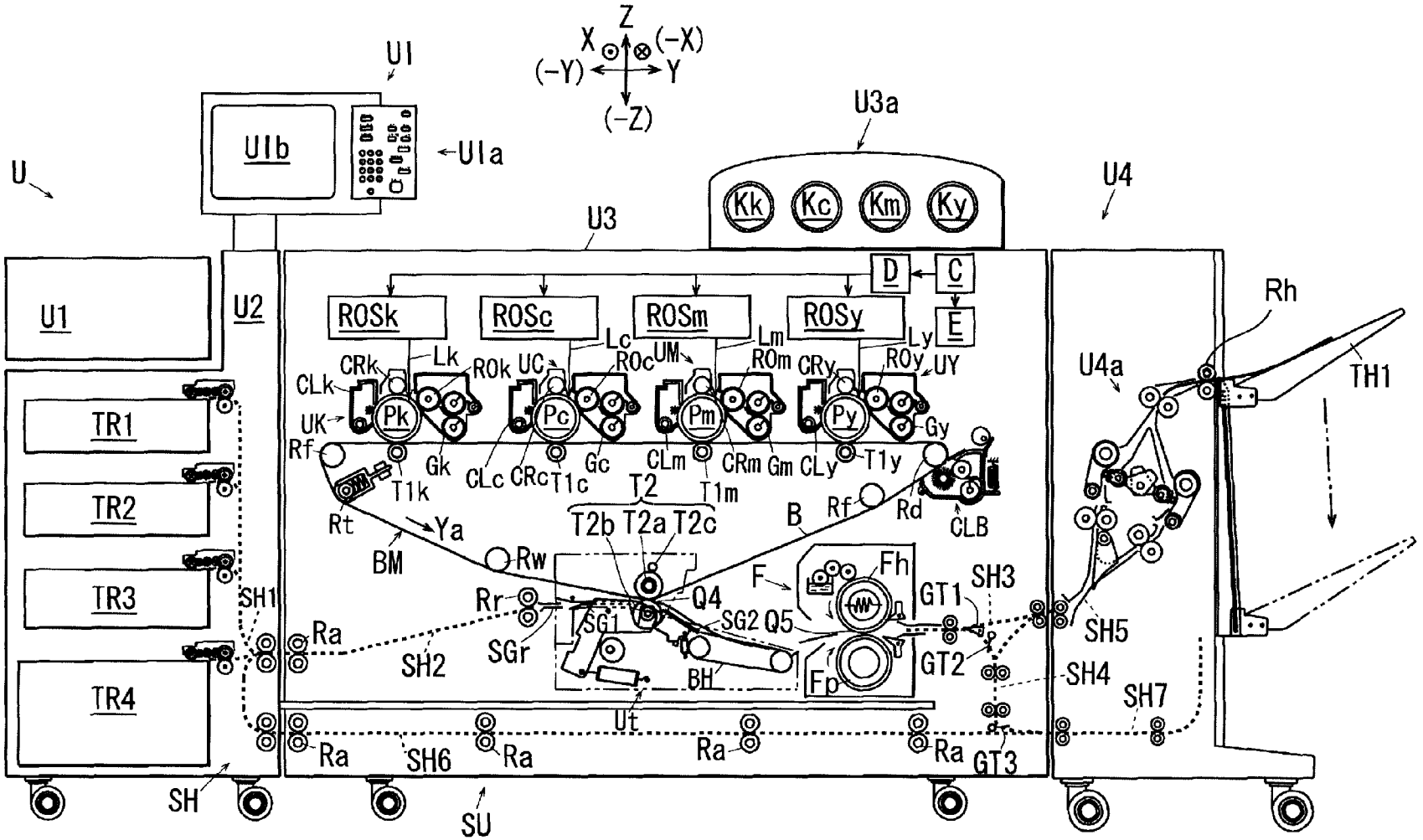
FIG. 1 is an explanatory view of an overall configuration of an image forming apparatus of the exemplary embodiment of the invention.

Hereinafter, an exemplary embodiment of the present invention will be described with reference to accompanying drawings. It should be noted that the present invention is not limited to the exemplary embodiment described below.

In order to improve the understanding of the following explanation, the back and forth direction is defined as an X-axis direction; the left and right direction is defined as a Y-axis direction; and the up and down direction is defined as a Z-axis direction, respectively in the drawings. Also, directions or sides shown by arrows X, −X, Y, −Y, Z and −Z are defined as a forward direction, a rearward direction, a rightward direction, a leftward direction, an upward direction and a downward direction, respectively, or a forward side, a rearward side, a right side, a left side, an upward side and a downward side, respectively.

Also, in the drawings, a symbol having a dot in a circle represents an arrow pointing from the rear to the front in the drawings; and a symbol having a cross in a circle represents an arrow pointing from the front to the rear in the drawings.

In the accompanying drawings, illustration of components other than those which should be explained is properly omitted.

FIG. 1 is an explanatory view of an overall configuration of an image forming apparatus of an exemplary embodiment according to the present invention.

As shown in FIG. 1, a copying machine U, which is shown as an example of the image forming apparatus, includes an user interface UI, a scanner unit U1, a sheet feeding unit U2, a main unit U3 and a sheet processing unit U4. In the exemplary embodiment, the scanner unit U1, the sheet feeding unit U2, the main unit U3 and the sheet processing unit U4 are configured to be detachable from one another.

The user interface UI includes an input button UIa which is used for starting copying, setting up the number of copying sheets and the like. Also, the user interface UI includes a display unit UIb in which the details inputted by the input button UIa and the state of the copying machine U are displayed.

The scanner unit U1 is configured to have an automatic original conveying device and an image scanning device. In the scanner unit U1, an original disposed therein is exposed to light, and a reflected light is received by a solid imaging element and converted into image information of red (R), green (G) and blue (B), which is then inputted into the main unit U3 at a preset time, so-called timing.

The sheet feeding unit U2 includes a plurality of sheet feeding trays TR1, TR2, TR3 and TR4, which serves as an example of a sheet container. Also, the sheet feeding unit U2 includes a sheet feeding path SH1 in which a sheet S shown as an example of a sheet on which an image is formed, which is accommodated in each of the sheet feeding trays TR1 to TR4, is taken out and conveyed into the main unit U3.

As shown in FIG. 1, the main unit U3 is provided with an image forming section for performing image formation on the sheet S which is conveyed from the sheet feeding unit U2, a developer supplying device U3*a*, a sheet conveying path SH2, a sheet discharging path SH3, a sheet reversing path SH4, and a sheet circulating path SH6.

The main unit U3 is also provided with a controller C, a laser drive circuit D as an example of a latent image forming device drive circuit, which is controlled by the controller C, and a power circuit E. The laser drive circuit D performs conversion into image information of Y (yellow), M (magenta), C (cyan) and K (black) based on the image information of red (R), green (G) and blue (B) which has been inputted from the scanner unit U1 and outputs drive signals corresponding thereto into latent image forming device of respective colors, ROSy, ROSm, ROSc and ROSk at a preset timing.

Figure 2:
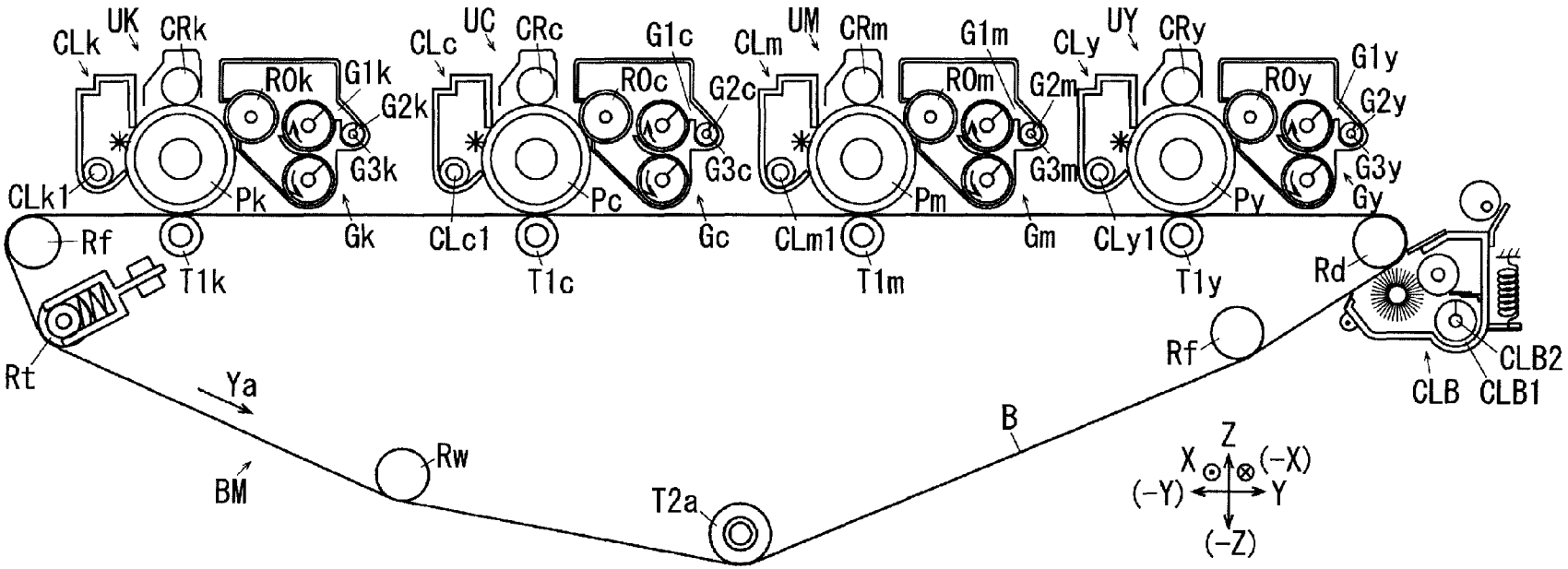
FIG. 2 is an enlarged explanatory view of a visible image forming apparatus and an intermediate transfer member cleaner.

FIG. 2 is an enlarged explanatory view of a visible image forming apparatus and an intermediate transfer member cleaner.

As shown in FIGS. 1 and 2, photoconductor units UY, UM, UC and UK, which serves as an example of a bearing member unit, are disposed in lower parts of the latent image forming devices of respective colors, ROSy, ROSm, ROSc and ROSk.

The photoconductor unit UK of a K color includes a photoconductor drum Pk as an example of an image carrier on which an electrostatic latent image or a toner image as an example of a visible image is formed, a charge roller CRk as an example of a charger and a photoconductor cleaner CLk as an example of an image carrier cleaner.

A developing device Gk as an example of a developer is disposed on the right side of the photoconductor unit UK. The developing device Gk is disposed opposite to the photoconductor drum Pk, include a developing roller ROk as an example of a developer bearing member which bears a developer on the surface thereof and rotates and develops a latent image on the surface of the photoconductor drum Pk into a visible image.

With respect to other colors Y, M and C, there are similarly provided photoconductor units UY, UM and UC including photoconductor drums Py, Pm and Pc, charge rollers CRy, CRm and CRc and cleaners CLy, CLm and CLc, respectively and developing devices Gy, Gm and Gc including developing rollers ROy, ROm and ROc, respectively.

A visible image forming apparatus (UK+Gk) of a K color is configured by the photoconductor unit UK of a K color and the developing device Gk including the developing roller ROk. Similarly, visible image forming apparatus (UY+Gy), (UM+Gm) and (UC+Gc) of Y, M and C are configured of the photoconductor units UY, UM and UC of Y, M and C and the developing devices Gy, Gm and Gc including developing rollers ROy, ROm and ROc, respectively.

The photoconductor units UY, UM, UC and UK and the developing devices Gy, Gm, Gc and Gy are each installed in a detachable manner relative to the main unit U3.

As shown in FIG. 1, the surfaces of the rotating photoconductor drums Py, Pm, Pc and Pk are uniformly charged by the charge rollers CRy, CRm, CRc and CRk, respectively, and thereafter, electrostatic latent images are formed on the surface of the rotating photoconductor drums Py, Pm, Pc and Pk, respectively by laser beams Ly, Lm, Lc and Lk as an example of latent image writing light, which are outputted by the image forming apparatus ROSy, ROSm, ROSc and ROSk. The electrostatic latent images on the surfaces of the photoconductor drums Py, Pm, Pc and Pk are developed into toner images as an example of visible images of colors of Y (yellow), M (magenta), C (cyan) and K (black), respectively by the developing devices Gy, Gm, Gc and Gk.

In the developing devices Gy to Gk, developers consumed by the development are supplied from toner cartridges Ky, Km, Kc and Kk, respectively as an example of a developer accommodating container, which are installed in the developer supplying device U3*a* in a detachable manner. In the exemplary embodiment, a two-component developer containing a toner and a carrier is used as the developer, and so-called high-concentration developers in which a proportion of the toner is higher than the toner concentration of each of the developing devices Gy to Gk are supplied from the toner cartridges Ky, Km, Kc and Kk, respectively. Accordingly, in the developing devices Gy to Gk of the exemplary embodiment, the developers each containing the deteriorated carrier are discharged little by little from the developing devices Gy to Gk while supplying the high-concentration developers each containing a small amount of the carrier, thereby exchanging the carrier.

In the developing devices Gy to Gk, not only the developers containing a deteriorated carrier are discharged from deteriorated developer discharge ports G1*y* to G1*k* into rear end parts of the developing devices Gy to Gk, but developers containing a fresh carrier are supplied from the toner cartridges Ky to Kk, whereby the developers within the developing devices Gy to Gk are each exchanged with a fresh developer little by little. The developers discharged from the deteriorated developer discharge ports G1*y* to G1*k* flow into deteriorated developer conveying paths G2*y* to G2*k* extending rearward and are conveyed rearward, respectively from deteriorated developer conveying components G3*y* to G3*k* disposed within the deteriorated developer conveying paths G2*y* to G2*k*.

The toner images on the surfaces of the photoconductor drums Py, Pm, Pc and Pk are successively overlapped and transferred onto an intermediate transfer belt B as an examples of an intermediate transfer member by primary transfer rollers T1*y*, T1*m*, T1*c* and T1*k* as an example of a primary transfer unit, whereby a multicolored image is formed on the intermediate transfer belt B. A color toner image as an example of a multicolored visible image which has been formed on the intermediate transfer belt B is conveyed into a secondary transfer region Q4.

In case of only image information of a K color, only the photoconductor drum Pk of a K color and the developing device Gk are used, and only the toner image of a K color is formed.

After the primary transfer, the residual developer and a residue such as a discharge product, which are deposited on the surfaces of the photoconductor drums Py, Pm, Pc and Pk, are removed by the cleaners CLy, CLm, CLc and CLk.

A belt module BM as an example of an intermediate transfer device is supported in a lower part of each of the visible image forming apparatus (UY+Gy), (UM+Gm), (UC+Gc) and (UK+Gk).

The belt module BM includes the intermediate transfer belt B. The intermediate transfer belt B is supported to be rotatable in an arrow Ya direction by a belt supporting roller (Rd+Rt+Rw+Rf+T2*a*) as an example of an intermediate transfer component supporting component, which is configured by a drive roller Rd as an example of an intermediate transfer member drive component, a tension roller Rt as an example of a tension generating component, a working roller Rw as an example of a meandering preventing component, plural idle rollers Rf as an example of a driven component and a backup roller T2*a* as an example of a secondary transfer opposing component.

The belt module BM of the exemplary embodiment is configured by the intermediate transfer belt B, the belt supporting roller (Rd+Rt+Rw+Rf+T2*a*) and the primary transfer rollers T1*y*, T1*m*, T1*c* and T1*k*.

A secondary transfer unit Ut is disposed in a lower part of the backup roller T2*a*. The secondary transfer unit Ut includes a secondary transfer roller T2*b* as an example of a secondary transfer component. The secondary transfer roller T2*b* is disposed across the intermediate transfer belt B such that it may be isolated from and brought into press contact with the backup roller T2*a*, and the secondary transfer region Q4 is provided by a region where the secondary transfer roller T2*b* is brought into press contact with the intermediate transfer belt B. Also, the backup roller T2*a* is brought into contact with a contact roller T2*c* as an example of a contact electric supply component. A secondary transfer voltage with the same polarity as a charge polarity of the toner is applied to the contact roller T2*c* from the power circuit E which is controlled by the controller C at a preset timing.

A secondary transfer unit T2 is configured by the backup rollers T2*a*, the secondary transfer roller T2*b* and the contact roller T2*c*.

Also, a transfer device (BM+T2) of the exemplary embodiment is configured by the belt module BM and the secondary transfer unit T2.

The sheet conveying path SH2 is disposed in a lower part of the belt module BM. The sheet S fed from the sheet feeding path SH1 of the sheet feeding unit U2 is conveyed into a registration roller Rr as an example of a timing regulating component of the sheet conveying path SH2 by a sheet conveying roller Ra as an example of a sheet conveying component. The registration roller Rr conveys the sheet S into a downstream side in conformity with a timing at which a color toner image formed on the intermediate transfer belt B is conveyed into the secondary transfer region Q4, and the sheet S is conveyed into the secondary transfer region Q4 upon being guided by a register guide SGr and a pre-transfer guide SG1.

The color toner image on the intermediate transfer belt B is transferred onto the sheet S by the secondary transfer unit T2 during passing through the secondary transfer region Q4. In case of a multicolored image, the toner images which have been overlapped on the surface of the intermediate transfer belt B and subjected to primary transfer are collectively subjected to secondary transfer onto the sheet S.

The intermediate transfer belt B after the secondary transfer is cleaned by a belt cleaner CLB as an example of the clear for intermediate transfer member, which is provided in a lower part of the right side of the intermediate transfer belt B. The developer remaining on the intermediate transfer belt B without being transferred at the time of secondary transfer and a residue such as a paper powder are removed from the intermediate transfer belt B by the belt cleaner CLB. As shown in FIG. 2, the residue which has been removed from the intermediate transfer belt B flows into a belt cleaner residue conveying path CLB1 extending rearward, which is provided in a bottom part within the belt cleaner CLB and is conveyed into the rear side of the main unit U3 by a belt cleaner residue conveying component CLB2 which is disposed within the belt cleaner residue conveying path CLB1. The secondary transfer roller T2*b* and the belt cleaner CLB are disposed such that they are freely isolated from and brought into contact with the intermediate transfer belt B.

The sheet S onto which a toner image has been subjected to secondary transfer passes through a post-transfer guide SG2 as an example of a guide component and a sheet conveying belt BH as an example of a conveying component and is conveyed into a fixing device F. The fixing device F includes a heating roller Fh as an example of a heat fixing component and a pressure roller Fp as an example of a pressure fixing component, and the sheet S is conveyed into a fixing region Q5 as a region where the heat roller Fh and the pressure roller Fp are brought into press contact with each other. The toner image on the sheet S is heat fixed by the fixing device F during passing through the fixing region Q5. A switching gate GT1 as an example of a switching component is provided on a downstream side of the fixing device F. The switching gate GT1 switches the sheet S which has been conveyed in the sheet conveying path SH2 and heat fixed in the fixing region Q5 to the side of either the sheet discharging path SH3 or the sheet reversing path SH4 of the sheet processing unit U4 selectively depending upon setting.

The sheet S which has been conveyed into the sheet discharging path SH3 is conveyed into a sheet conveying path SH5 of the sheet processing unit U4 and after a warp of the sheet S, a so-called curl, has been corrected by a curl correcting member U4*a* as an example of a warp correcting member, which is disposed in the sheet conveying path SH5, is discharged from a discharge roller Rh as an example of a sheet discharge component into a discharge tray TH1 as an example of a sheet disparage part of the sheet processing unit U4 in a state where the image recording face of the paper faces upward, a so-called face-up state.

The sheet S which has been conveyed into the side of the sheet reversing path SH4 of the main unit U3 by the switching gate GT1 passes through a mylar gate GT2 as an example of a flexible switching member and is conveyed into the sheet reversing path SH4 of the main unit U3.

At that time, when the sheet S is discharged in a state where the image fixing face faces downward, immediately after a rear end of the sheet S has passed through the mylar gate GT2, the sheet S is reversed. On that occasion, the mylar gate GT2 makes the sheet S which has been conveyed into the sheet reversing path SH4 pass therethrough once as it is, and when the passed sheet S has been reversed, conveys it into the sides of the sheet conveying paths SH3 and SH5. The sheet S is then discharged into the discharge tray TH1 in a state where the image fixing face faces downward, a so-called face-down state.

The sheet circulating path SH6 is connected on the way of the sheet reversing path SH4 of the main unit U3, and a mylar gate GT3 is disposed in its connection part. A downstream end of the sheet reversing path SH4 of the main unit U3 is connected to a sheet reversing path SH7 of the sheet processing unit U4.

The sheet S which has passed through the switching gate GT1 and been conveyed into the sheet conveying path SH4 is conveyed into the side of the sheet reversing path SH7 of the sheet processing unit U4 by the mylar gate GT3. The mylar gate GT3 makes the sheet S which has been conveyed into the sheet reversing path SH4 pass therethrough once as it is, and when the passed sheet S has been reversed, conveys it into the side of the sheet circulating path SH6. The sheet S which has been conveyed into the sheet circulating path SH6 passes through the sheet feeding path SH1 and is again sent to the transfer region Q4, subjected to duplex printing, conveyed into the sheet processing unit U4 and then discharged into the discharge tray TH1.

A sheet conveying path SH is configured by the elements represented by the symbols SH1 to SH7. A paper conveying device SU is configured by the elements represented by the symbols SH, Ra, Rr, Rh, SGr, SG1, SG2, BH and GT1 to GT3.

Figure 3:
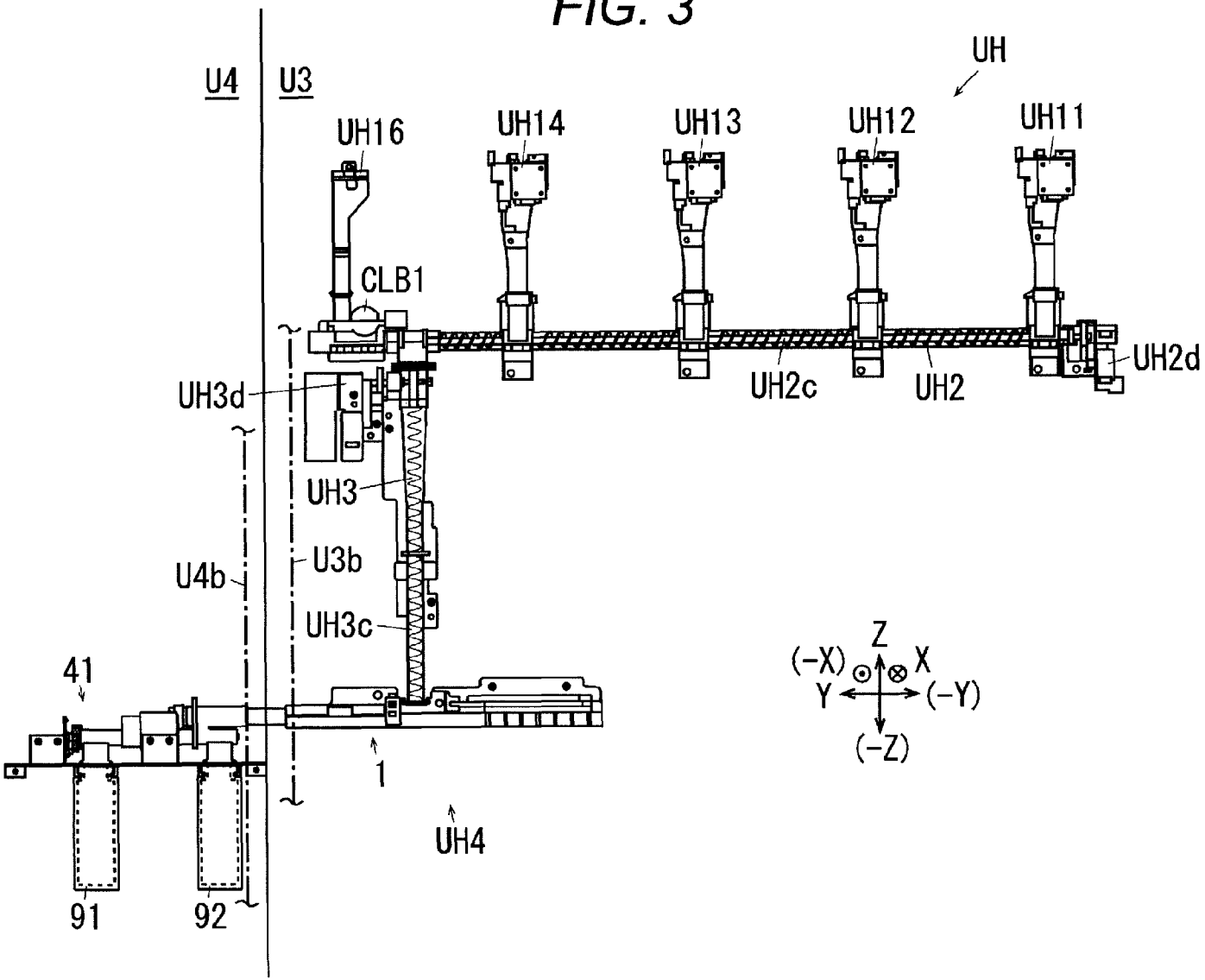
FIG. 3 is an explanatory view of a part of a developer conveying device.

FIG. 3 is an explanatory view of a part of a developer conveying device.

A waste developer conveying device UH, which serves as an example of a developer conveying device, is supported in a rear part of the main unit U3.

The waste developer conveying device UH includes five developer dropping units UH11, UH12, UH13, UH14 and UH16, which extend in the up and down direction. The first developer dropping unit UH11 which is disposed on the most left side, namely the most −Y side (the most right side in the expression of FIG. 3) is connected with a residue conveying path CLk1 extending from the cleaner CLk. The second developer dropping unit UH12 disposed on the right side of the first developer dropping unit UH11 is connected with a residue conveying path CLc1 extending from the cleaner CLc of a C color and the deteriorated developer conveying path G2*k* extending from the developing device Gk of a K color.

The third developer dropping unit UH13 disposed on the right side of the second developer dropping unit UH12 is connected with a residue conveying path CLm1 extending from the cleaner CLm of an M color and the deteriorated developer conveying path G2*c* extending from the developing device Gc of a C color. The fourth developer dropping unit UH14 disposed on the right side of the third developer dropping unit UH13 is connected with a residue conveying path CLy1 extending from the cleaner CLy of a Y color and the deteriorated developer conveying path G2*m* extending from the developing device Gm of an M color. The fifth developer dropping unit UH16 disposed on the right side of the fourth developer dropping unit UH14 is connected with the deteriorated developer conveying path G2*y* extending from the developing device Gy of a Y color. Furthermore, the belt cleaner residue conveying path CLB1 extending from the belt cleaner CLB is connected to the left side of the fifth developer dropping unit UH16.

Lower ends of the developer dropping units UH11 to UH16 are connected to each other via a merging conveying path UH2 extending in the horizontal direction. The merging conveying path UH2 of the exemplary embodiment is connected in a state where the lower ends of the developer dropping units UH11 to UH16 penetrate therethrough in the left and right direction, and a merging conveying auger UH2*c* as an example of the conveying component extending in the left and right direction is accommodated in the inside of the merging conveying path UH2. Driving power is transmitted from a merging conveying motor UH2*d*, which serves as an example of a drive source, to a left end of the merging conveying auger UH2*c*, and the waste developer within the merging conveying path UH2 is conveyed from the left to the right.

An upper end of a dropping conveying path UH3, which serves as an example of the path extending in the up and down direction, is connected in a right end of the merging conveying path UH2, and the waste developer which has been conveyed to the right end of the merging conveying path UH2 flows into the dropping conveying path UH3 and drops and is then conveyed. A crosslinking preventing member UH3*c* which extends in the up and down direction and breaks the deposited waste developer on the inner wall surface of the dropping conveying path UH3 upon being reciprocated in the up and down direction is accommodated in the inside of the dropping conveying path UH3 of the exemplary embodiment. The crosslinking preventing member UH3*c* of the exemplary embodiment is configured by a coil spring in which a wire is formed in a spiral form. A crosslinking preventing motor unit UH3*d* for reciprocating the crosslinking preventing member UH3*c* in the up and down direction is supported on the upper right side of the dropping conveying path UH3.

(Explanation of Developer Collection Device)

Figure 4:
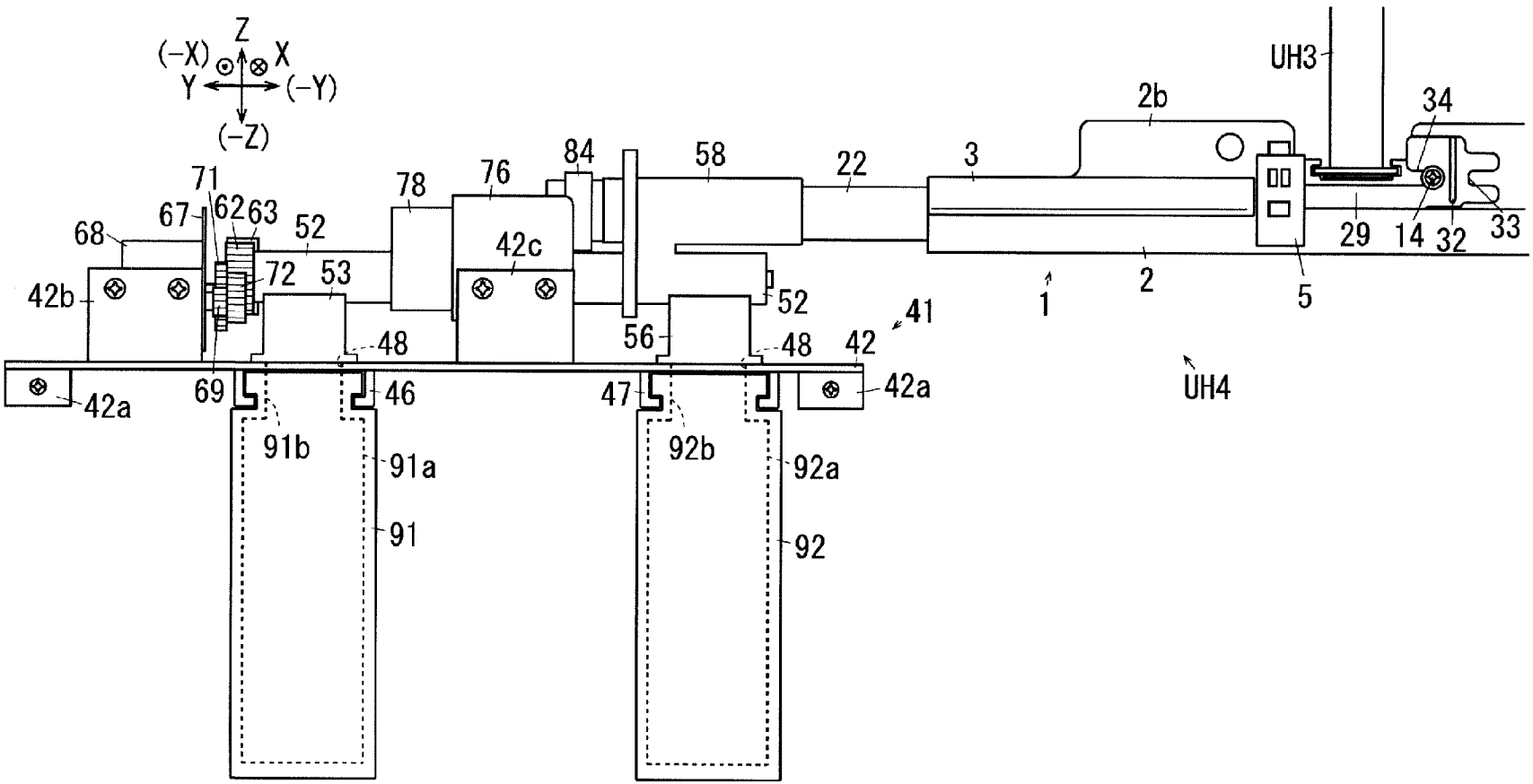
FIG. 4 is an explanatory view of a part of a developer collection device of the exemplary embodiment.

FIG. 4 is an explanatory view of a part of a developer collection device of the exemplary embodiment.

Figure 5:
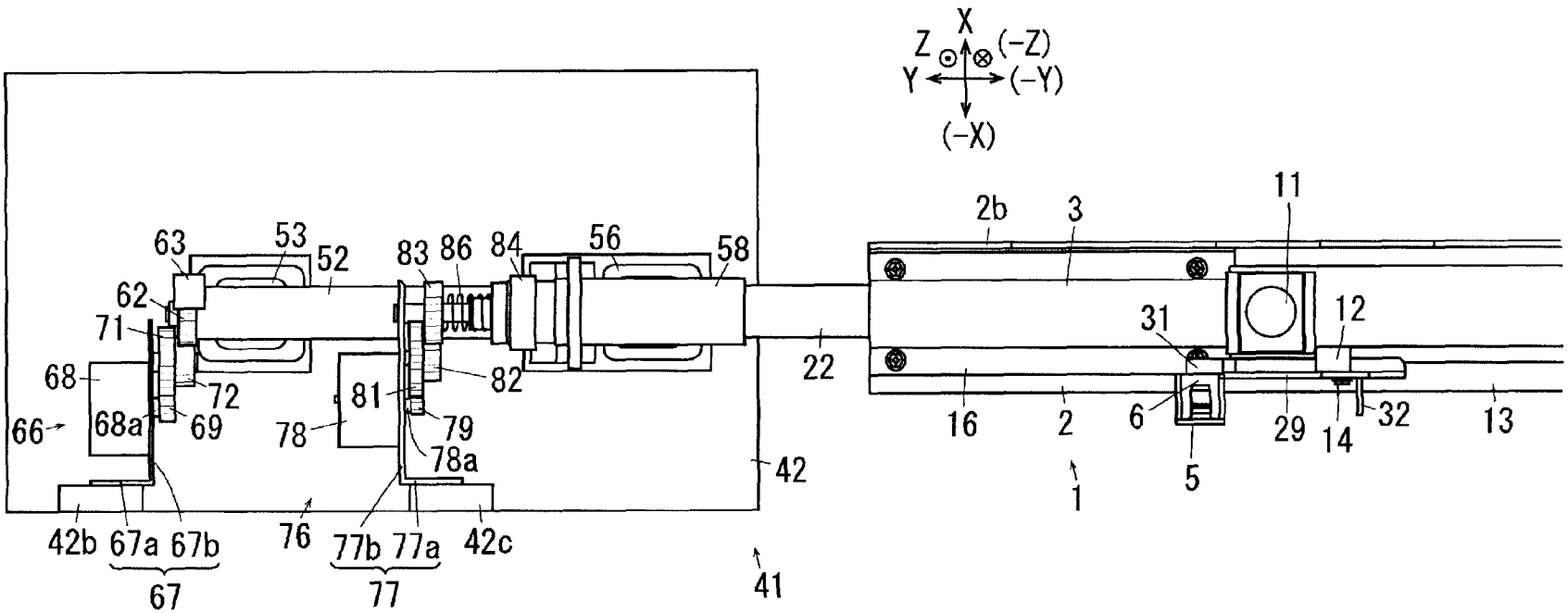
FIG. 5 is a plan view of a developer collection device of the exemplary embodiment.

FIG. 5 is a plan view of a developer collection device of the exemplary embodiment.

Figure 6:
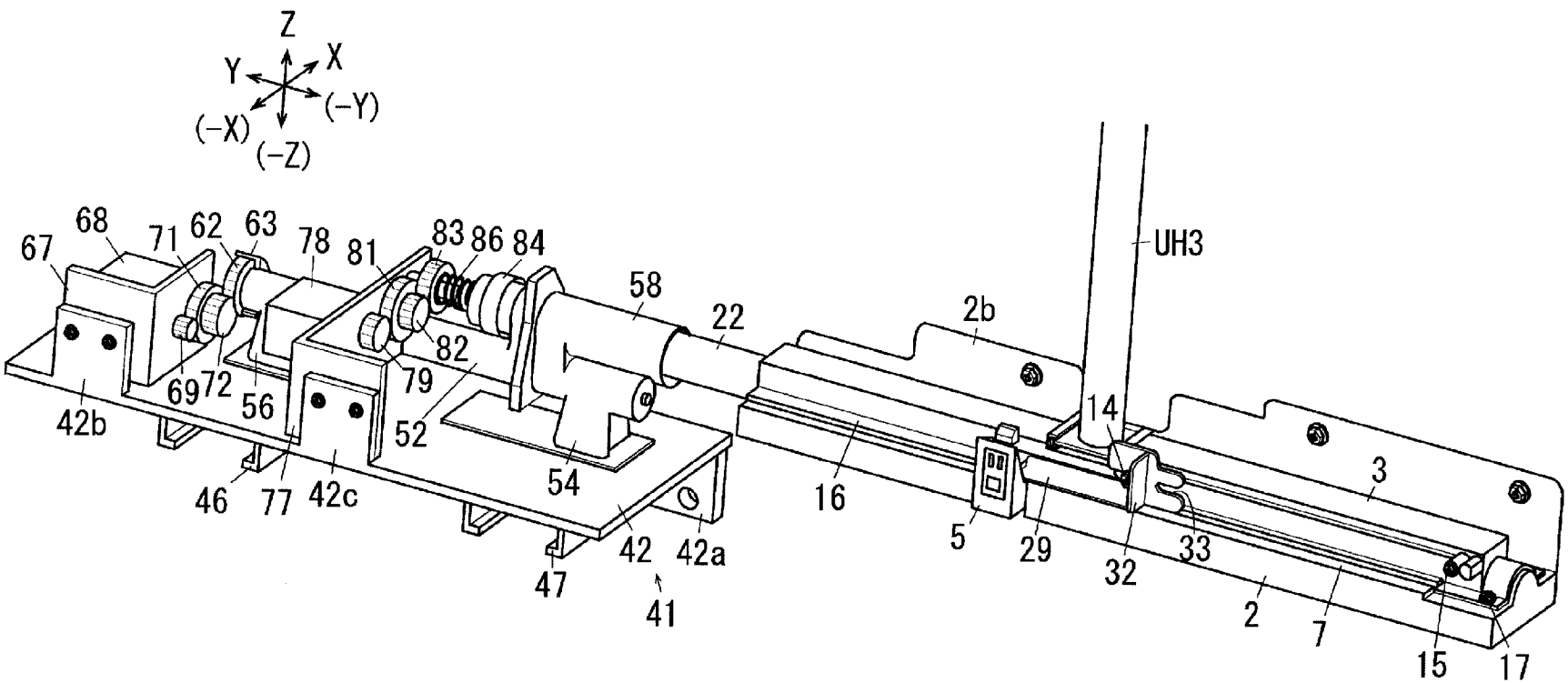
FIG. 6 is an oblique view of the developer collection device of the exemplary embodiment.

FIG. 6 is an oblique view of the developer collection device of the exemplary embodiment.

Figures 7A, 7B, 7C, 7D, 7E, 7F:
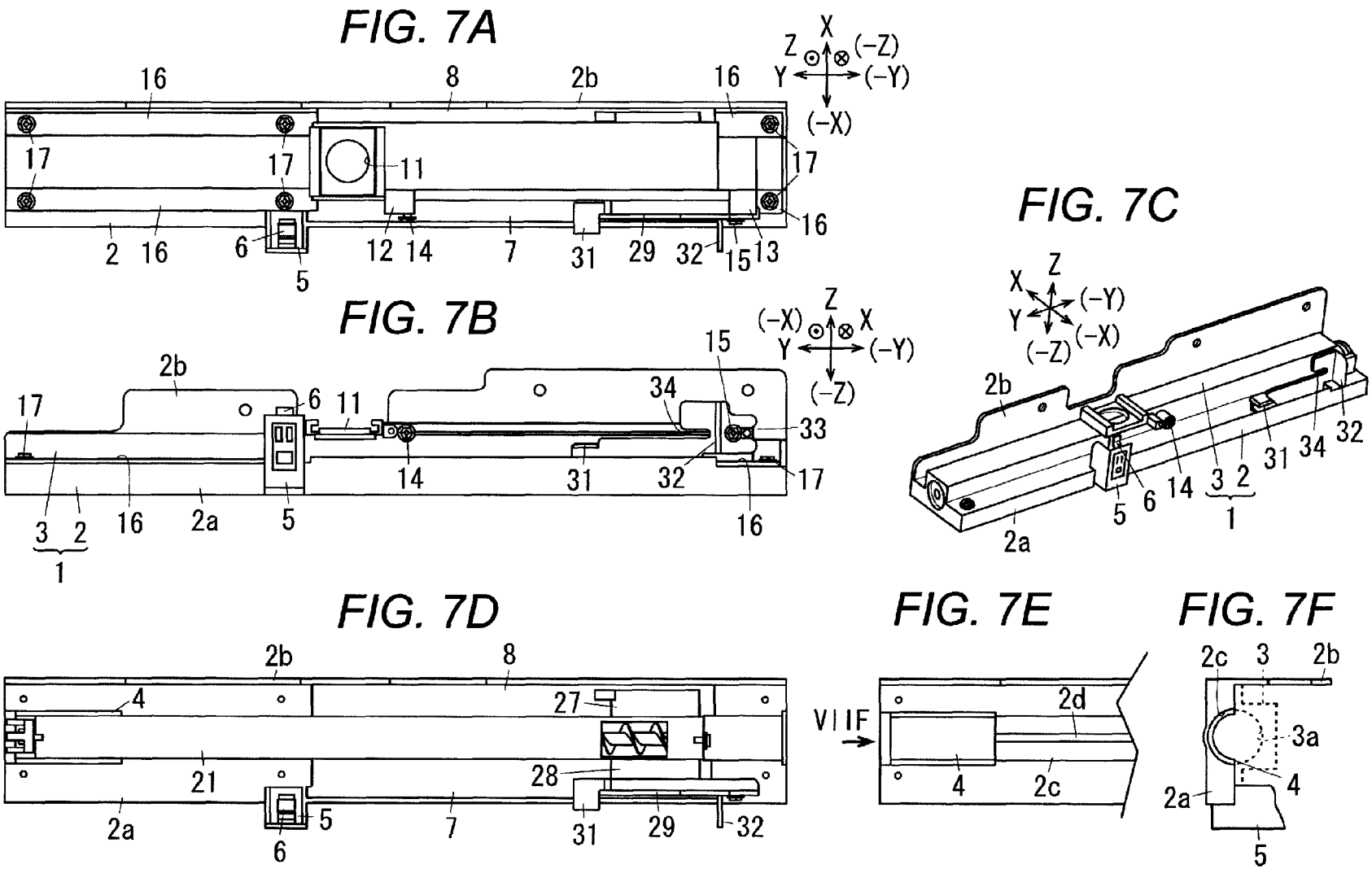

FIGS. 7A-7F are explanatory views of a connection unit of the exemplary embodiment, wherein: FIG. 7A is a plan view; FIG. 7B is a side view; FIG. 7C is an oblique view; FIG. 7D is a plan view in a state where a lid is removed from FIG. 7A; FIG. 7E is an enlarged view of a right end part of a pipe cover in a state where a connection pipe is removed in FIG. 7D; and FIG. 7F is a view seen from an arrow VIIF direction of FIG. 7E.

As shown in FIGS. 3 to 6, a waste toner collection device UH4, which serves as an example of a developer collection device, is supported in a lower end of the dropping conveying path UH3. A pipe cover 1, which serves as an example of a movable supporting member extending in the left and right direction, is supported in the waste toner collection device UH4. As shown in FIGS. 7A to 7F, the pipe cover 1 includes a cover base 2 as an example of a supporting part main body and a cover lid 3 as an example of a lid component. The cover base 2 includes a plate-shaped base part 2*a* extending in the left and right direction and a fixed part 2*b* extending upward from a front end of the base part 2*a*. Accordingly, the cover base 2 of the exemplary embodiment is fixed and supported in a rear frame U3*b* of the main unit U3 as an example of a second frame by the fixed part 2*b*.

As shown in FIGS. 7D and 7F, a semicylindrical pipe guide groove 2*c* as an example of a connection supporting part, which extends in the left and right direction, is provided in the base part 2*a*. As shown in FIG. 7E, a pipe seal 4, which serves as an example of a leak preventing component for preventing a leak of the developer, is adhered to a right end part of the pipe guide groove 2*c*. As shown in FIG. 7E, a guide concave groove 2*d*, which serves as an example of a protrusion guiding part, which extends in the left and right direction, is provided in the bottom of the pipe guide groove 2*c*.

As shown in FIGS. 7A to 7F, a sensor holder 5 as an example of a detection supporting part, which extends upward, is fixed and supported on a rear face of the center of the base part 2*a* in the left and right direction, and a photo sensor 6 as an example of a detection component is supported in the sensor holder 5.

As shown in FIG. 7D, plate guide faces 7 and 8 as an example of a guide face, which are provided before and after the pipe guide groove 2*c* and which extend in the left and right direction, are provided in the left relative to the sensor holder 5.

As shown in FIGS. 7A to 7F, a cover port 11 as an example of an opening, to which is connected a lower end of the dropping conveying path UH3, is provided in the center of the cover lid 3 in the left and right direction.

A first screw receiving part 12 as an example of an extracted position fixing part, which protrudes rearward, is provided in the left of the cover port 11, and a second screw receiving part 13 as an example of a retracted position fixing part, which protrudes rearward, is provided in a left end part of the cover lid 3. Position fixing screws 14 and 15 as an example a position fixing component are screwed in the screw receiving parts 12 and 13, respectively. As shown in FIG. 7B, the position fixing screws 14 and 15 are disposed at a position of the same height.

A plate-shaped installing part 16 extending in the left and right direction is provided in a portion other than the regions corresponding to the plate guide faces 7 and 8 in both of the front and rear terminal edges of the cover lid 3, and the cover lid 3 is fixed and supported in the cover base 2 by the screw 17 in the stalling part 16.

As shown in FIG. 7F, a semicylindrical pipe guide groove 3*a* corresponding to the pipe guide groove 2*c* is provided on the lower face of the cover lid 3. Thus, a non-illustrated cylindrical pipe accommodating part (2*c*+3*a*) extending in the left and right direction is provided by the cover base 2 and the pipe cover grooves 2*c* and 3*a* of the cover lid 3 in the inside of the pipe cover 1.

Figure 8A:
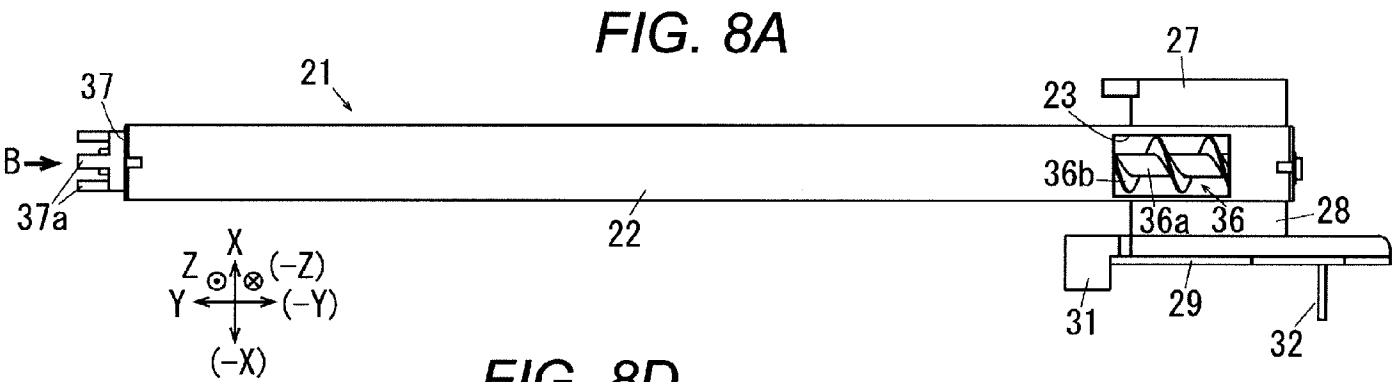
Figure 8B:
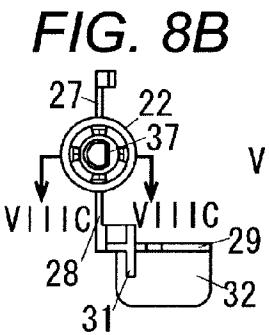
Figure 8C:
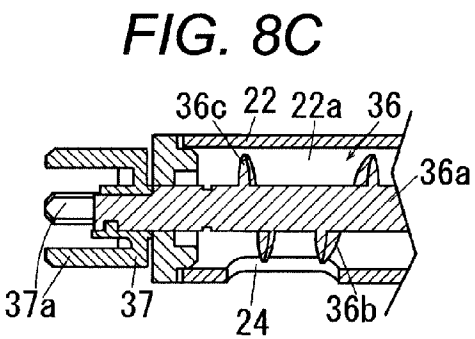
Figure 8D:
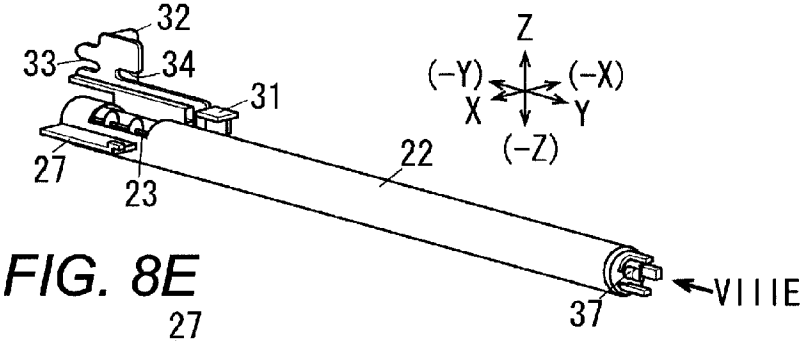
Figure 8E:
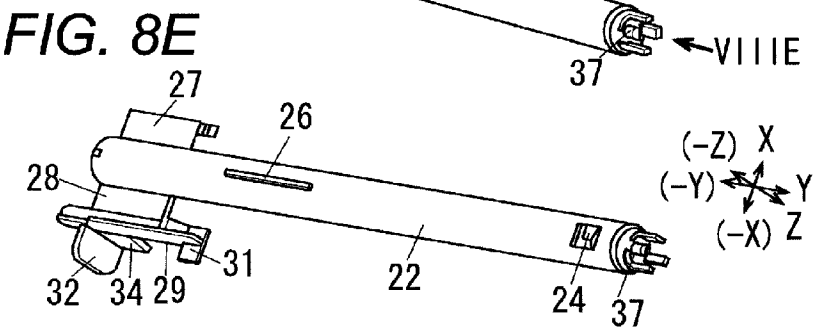

FIGS. 8A-8E are explanatory views of the connection unit of the exemplary embodiment, wherein: FIG. 8A is a plan view; FIG. 8B is a view seen from an arrow VIIIB direction of FIG. 8A; FIG. 8C is a sectional view of a VIIIC-VIIIC line of FIG. 8B; FIG. 8D is an oblique view; and FIG. 8E is a view seen from an arrow VIIIE direction of FIG. 8D.

As shown in FIGS. 3 to 8E, a connection pipe 21 as an example of a connection unit is supported to be movable in the left and right direction in the pipe accommodating part (2*c*+3*a*) in the inside of the pipe cover 1. As shown in FIGS. 8A to 8E, the connection pipe 21 includes a cylindrical pipe main body 22 as an example of a connection conveying part, which extends in the left and right direction. As shown in FIG. 8C, a connection path 22*a* is provided in the inside of the pipe main body 22.

As shown in FIGS. 8A and 8D, a pipe inlet port 23 as an example of an upstream connection port, which is opened in an upper face and which makes a developer flow into the connection path 22*a*, is provided in a left end of the pipe main body 22. As shown in FIGS. 8C and 8E, a pipe outlet port 24 as an example of a connection outlet port, which is opened in a lower face and through which a developer flows out from the connection path 22*a*, is provided in a right end of the pipe main body 22.

As shown in FIG. 8E, a convex part 26 extending in the left and right direction is provided in a lower face of the left of the pipe main body 22 and configured such that it may be guided in the left and right direction in a fitted state in the guide concave groove 2*d*.

As shown in FIGS. 7A to 7F and 8A to 8E, plate-shaped front guide plate 27 and rear guide plate 28 as an example of a part to be guided, each of which protrudes in the back and forth direction, are provided in a left end of the pipe main body 22 and configured such that they may be guided in the left and right direction along the plate guide faces 7 and 8. The front guide plate 27 and rear guide plate 28 are exposed to the outside from the pipe accommodating part (2*c*+3*a*) through a space between the cover base 2 provided along the plate guide faces 7 and 8 and the cover lid 3.

A rear end wall 29 extending upward is provided in a rear end part of the rear guide plate 28. A plate to be detected 31 as an example of a detected part, which when the connection pipe 21 moves to the extracted position shown in FIGS. 4 to 6, enters a position of the photo sensor 6 and is detected, is integrally provided in a right end of the rear end wall 29.

A knob part 32 as an example of an user interface, which protrudes rearward such that a worker may pinch and operate it, is provided in the left of the read end wall 29.

Furthermore, a left-and-right pair of notch-shaped retracted position fixing slit 33 and extracted position fixing slit 34 as an example of a position fixing part, each of which extends from the outside to the inside, is provided on the left-and-right both sides of the knob part 32 in the rear end wall 29. As shown in FIG. 7B, the respective slits 33 and 34 are provided corresponding to the positions of the position fixing screws 14 and 15. Accordingly, in a state where the connection pipe 21 moves to the retracted position shown in FIG. 7B, the retracted position fixing slit 33 is in a state where it is fitted in the left-side position fixing screw 15, and when the position fixing screw 15 is fastened, the connection pipe 21 is in a state where it may be fixed at the retracted position. Also, in a state where the connection pipe 21 moves from the retracted position shown in FIG. 7B to the right to arrive at the extracted position shown in FIGS. 4 and 6, the extracted position fixing slit 34 is in a state where it is fitted in the right-side position fixing screw 14, and when the position fixing screw 14 is fastened, the connection pipe 21 is in a state where it may be fixed at the extracted position.

In the exemplary embodiment, in the extracted position, the pipe inlet port 23 and the cover port 11 are connected, whereby the developer from the dropping conveying path UH3 may flow into the connection path 22*a*; and at the retracted position, the pipe inlet port 23 and the cover port 11 are deviated from each other, whereby the developer may not flow thereinto.

As shown in FIGS. 8A, 8C and 8D, a relay auger 36 as an example of a connection conveying member is supported in a rotatable manner within the connection path 22*a* in the inside of the pipe main body 22. The relay auger 36 includes a rotation axis 36*a* extending in the left and right direction. A helical conveying blade 36*b* which is supported on the outer periphery corresponding to a region of the pipe outlet port 24 from a left end of the connection path 22*a* is provided on the rotation axis 36*a*, and as shown in FIG. 8C, a helical reverse conveying blade 36*c* which is wound in a reverse direction to the conveying blade 36*b* is provided in a portion of the right side relative to the pipe outlet port 24.

As shown in FIGS. 8A to 8E, a right end part of the rotation axis 36*a* penetrates through the right end of the pipe main body 22 and protrudes outward, and a coupler 37 having plural tabs 37*a* as an example of a transmitted member is supported in the protruded right end.

As shown in FIG. 3, a collection unit 41, which serves as an example of a collection unit, is disposed in the right of the pipe cover 1. As shown in FIGS. 3 to 6, the collection unit 41 includes a plate-shaped collection unit base 42 as an example of a unit base part, which extends in the left and right direction. A fixed part 42*a* extending downward is provided in a front end of the collection unit base 42, and the collection unit 41 is supported in a frame U4*b* of the sheet processing unit U4 as an example of a first frame by the fixed part 42*a*. A left-and-right pair of motor unit supporting parts 42*b* and 42*c* as an example of a drive system supporting part, each of which extends upward, is provided in a rear end of the collection unit base 42.

As shown in FIGS. 4 and 6, box installing parts 46 and 47 as an example of a container installing part are provided on the lower face of the collection unit base 42. As shown in FIG. 4, an opening 48 through which the developer may pass and which penetrates in the up and down direction is provided corresponding to the box installing parts 46 and 47, respectively.

Figures 9A, 9B, 9C, 9D, 9E:
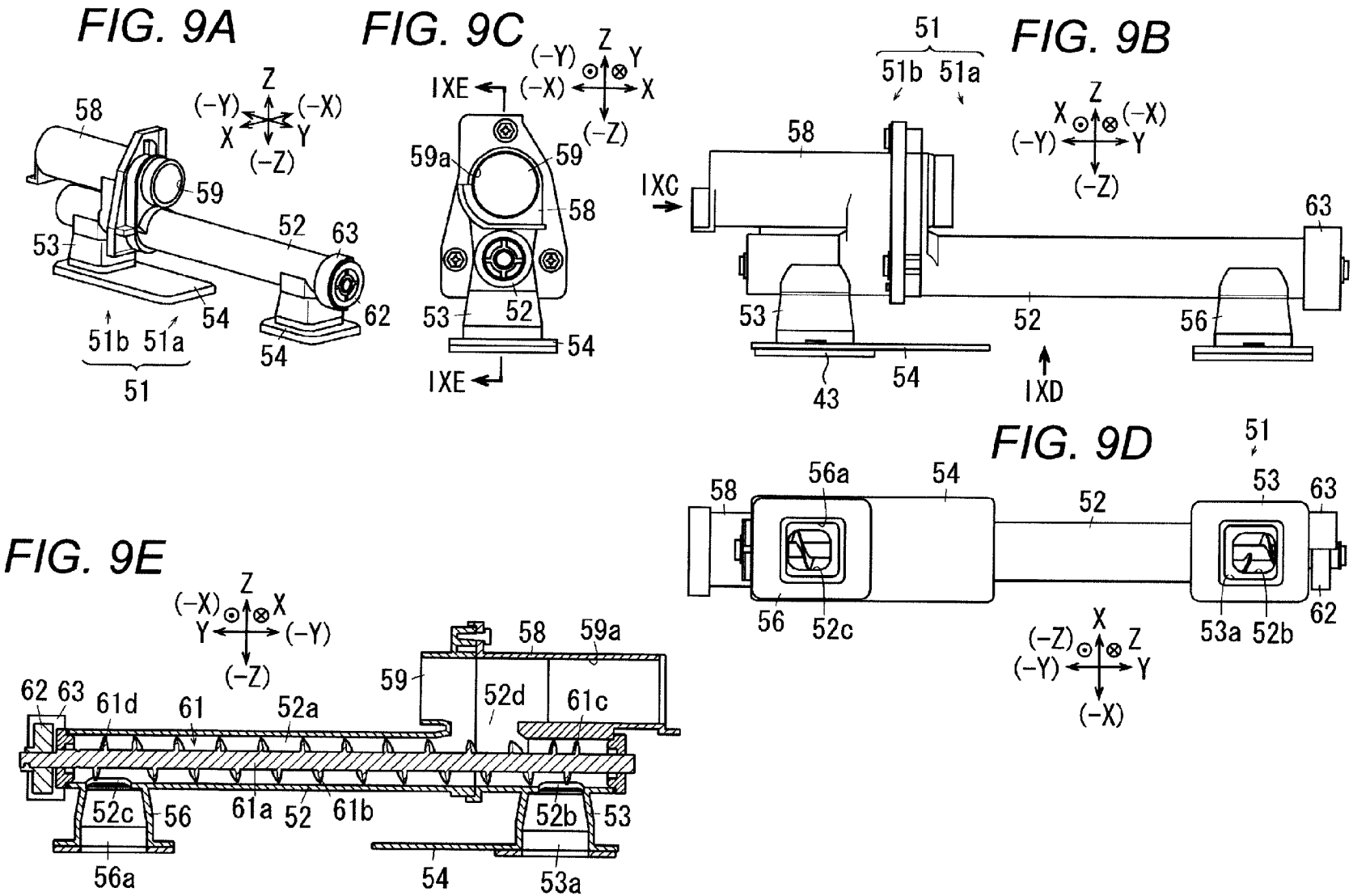

FIGS. 9A-9E are explanatory views of a linking component of the exemplary embodiment, wherein: FIG. 9A is an oblique view;

FIG. 9B is a side view; FIG. 9C is a view seen from an arrow IXC direction of FIG. 9B; FIG. 9D is a view seen from an arrow IXD direction of FIG. 9B; and FIG. 9E is a sectional view of a IXE-IXE line of FIG. 9C.

As shown in FIGS. 4 to 6, a bottle joint 51 as an example of a linking component is supported in the collection unit base 42. As shown in FIGS. 9A to 9E, the bottle joint 51 is configured such that a right joint 51*a* as an example of a right-side linking component and a left joint 51*b* as an example of a left-side linking component are screwed.

The bottle joint 51 includes a cylindrical collection conveying pipe 52 as an example of a collection conveying part, which extends in the left and right direction. As shown in FIG. 9E, a collection conveying path 52*a* extending in the left and right direction is provided in the inside of the collection conveying pipe 52. A first collection port 52*b* which is opened downward is provided in a left end part of the collection conveying path 52*a*, and a second collection port 52*c* which is opened downward is provided in a right end part of the collection conveying path 52*a*. Also, an inlet port 52*d* which is opened upward is provided in the left of the collection conveying path 52*a*.

A first bottle dropping part 53 as an example of a first container connection part, which extends downward from a position corresponding to the first collection port 52*b*, is integrally provided in a left end part of the collection conveying pipe 52. A first bottle dropping path 53*a* as an example of a first container connection path, which extends in the up and down direction, is provided in the inside of the first bottle dropping part 53; and an upper end of the first bottle dropping path 53*a* is connected to the first collection port 52*b*, with a lower end thereof being connected to the left-side opening 48.

As shown in FIGS. 9A to 9E, a fixed part 54 extending to the right is integrally provided in the first bottle dropping part 53, and the bottle joint 51 is fixed and supported on a supporting plate 43 at the fixed part 54.

A second bottle dropping part 56 as an example of a second container connection part, which extends downward from a position corresponding to the second collection port 52*c*, is integrally provided in a right end part of the collection conveying pipe 52. A second bottle dropping path 56*a* as an example of a second container connection path, which extends in the up and down direction, is provided in the inside of the second bottle dropping part 56; and an upper end of the second bottle dropping path 56*a* is connected to the second collection port 52*c*, with a lower end thereof being connected to the right-side opening 48.

A cylindrical linking pipe 58 as an example of an upstream connection part, which extends in the left and right direction in parallel to the collection conveying pipe 52, is integrally provided in the left of the collection conveying pipe 52. A pipe penetration part 59 as an example of a linking supporting part, which the connection pipe 21 may penetrate therethrough in the left and right direction and be linked therewith, is provided in the inside of the linking pipe 58, and the pipe penetration part 59 is connected to the inlet port 52*d*. A pipe guide face 59*a* as an example of a guide face, which is formed such that an inside diameter thereof increases toward the left, is provided in the left of the inner periphery of the pipe penetration part 59 of the exemplary embodiment, and the connection pipe 21 to be inserted is guided thereinto. As shown in FIGS. 4 to 6, the configuration is made such that in a state where the connection pipe 21 moves to the extracted position, the connection pipe 21 is linked in a state where it penetrates through the pipe penetration part 59, and the pipe outlet port 24 of the connection pipe 21 is connected to the inlet port 52*d*, whereby the developer from the connection pipe 21 may flow into the collection conveying path 52*a*.

As shown in FIG. 9E, a collection auger 61 as an example of a collection conveying component, which extends in the left and right direction, is supported to be rotatable in the collection conveying path 52*a* in the inside of the collection conveying pipe 52. The collection auger 61 includes a rotation axis 61*a* extending in the left and right direction. A helical principal conveying blade 61*b* is supported in a region between the first collection port 52*b* and the second collection port 52*c* on the outer periphery of the rotation axis 61*a*; a first helical reverse blade 61*c* which is wound in a reverse direction to the principal conveying blade 61*b* is supported in the left side relative to the first collection port 52*b*; and a second helical reverse blade 61*d* which is wound in a reverse direction to the principal conveying blade 61*b* is supported in the right side relative to the second collection port 52*c*.

A right end of the rotation axis 61*a* penetrates through the collection conveying pipe 52 and extends outward, and a gear to be driven 62 as an example of a component to be driven is supported in an outer end of the rotation axis 61*a*. A semicylindrical gear cover 63 as an example of a protective component, which covers a front side of the gear to be driven 62, is integrally provided in a right end of the collection pipe 52.

As shown in FIGS. 4 to 6, a collection motor unit 66 as an example of a collection drive unit is supported in the right-side motor unit supporting part 42*b*. The collection motor unit 66 includes a supporting part 67 including a plate-shaped fixed part 67*a* extending in the left and right direction and a plate-shaped toothed wheel supporting part 67*b* extending forward from a left end of the fixed part 67*a*. Accordingly, the collection motor unit 66 is fixed and supported in the right-side motor unit supporting part 42*b* in the fixed part 67*a*. A collection motor 68 as an example of a collection drive source is fixed and supported on the right face of the toothed wheel supporting part 67*b*. A drive axis 68*a* of the collection motor 68 penetrates through the toothed wheel supporting part 67*b* and protrudes to the left, and a drive gear 69 as an example of a drive toothed wheel is supported in a left end of the drive axis 68*a*.

A first intermediate gear 71 as an example of an intermediate toothed wheel, which gears with the drive gear 69, and a second intermediate gear 72 which is coaxially disposed with the first intermediate gear 71 and which gears with the gear to be driven 62 are supported in a rotatable manner on the front side of the drive gear 69.

Accordingly, the collection auger 61 which rotates integrally with the gear to be driven 62 via the respectively gears 69 to 72 is rotated by drive of the collection motor 68. The collection motor 68 of the exemplary embodiment is configured in a reciprocally rotatable manner, and when the collection motor 68 is positively driven, the developer within the collection conveying path 52*a* is conveyed toward the first collection port 52*b*, whereas when the collection motor 68 is reversely driven, the developer within the collection conveying path 52*a* is conveyed toward the second collection port 52*c*.

As shown in FIGS. 4 to 6, a connection motor unit 76, which serves as an example of a connection drive unit, is supported in the left-side motor unit supporting part 42*c*. The connection motor unit 76 includes a supporting plate 77 including a plate-shaped fixed part 77*a* extending in the left and right direction and a plate-shaped toothed wheel supporting part 77*b* extending forward from a right end of the fixed part 77*a*. Accordingly, the connection motor unit 76 is fixed and supported in the left-side motor unit supporting part 42*c* in the fixed part 77*a*.

The toothed wheel supporting part 77*b* extends forward across the collection conveying pipe 52, and a connection motor 78 as an example of a connection actuator is fixed and supported on the right face of the toothed wheel supporting part 77*b*. A drive axis 78*a* of the connection motor 78 penetrates through the toothed wheel supporting part 77*b* and protrudes to the left, and a drive gear 79 as an example of a drive toothed wheel is supported in a left end of the drive axis 78*a*.

Figure 10:
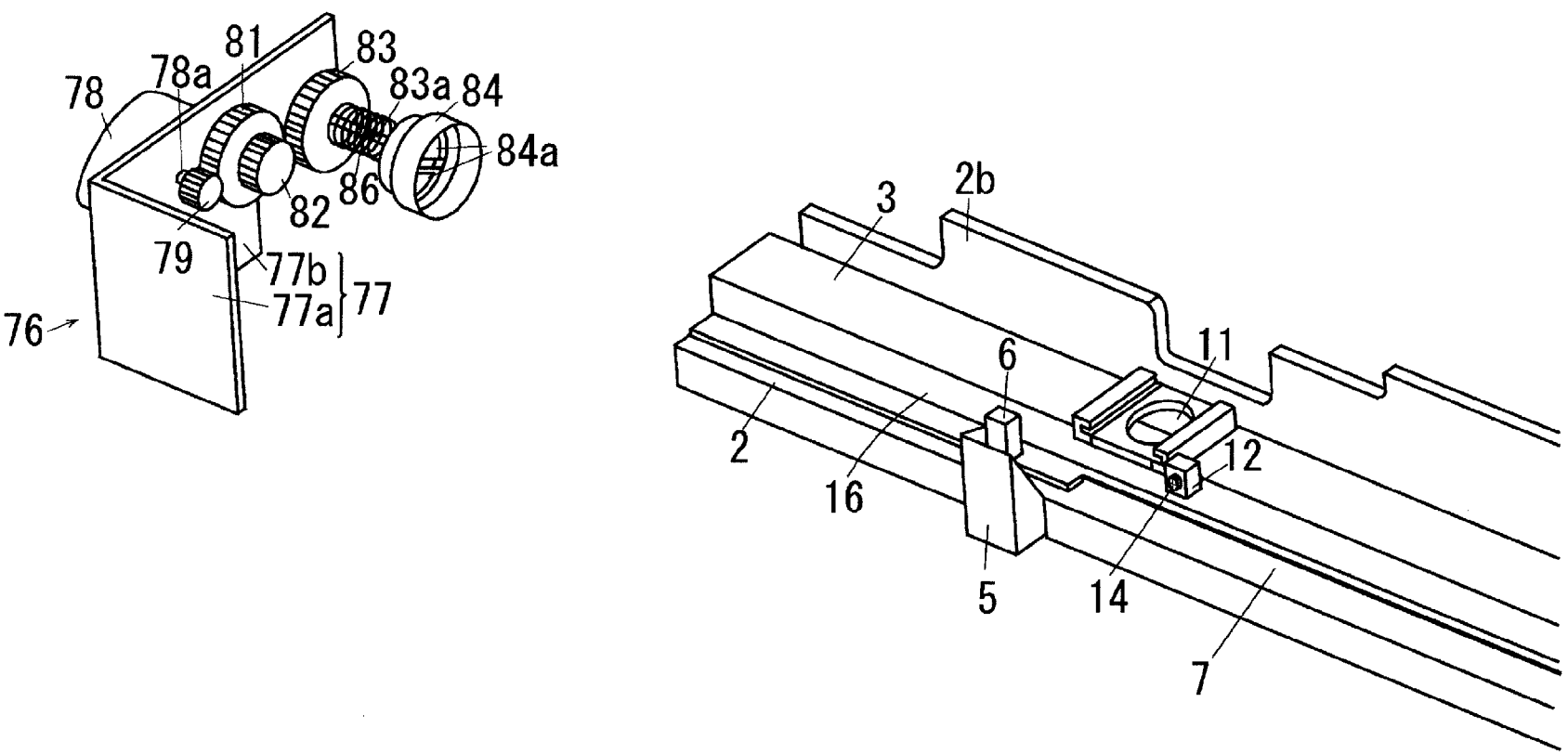
FIG. 10 is an explanatory view of a part in a state where the connection pipe of the exemplary embodiment has moved to a retracted position.

FIG. 10 is an explanatory view of a relevant part in a state where a connection pipe of the exemplary embodiment has moved to a retracted position.

Figure 11:
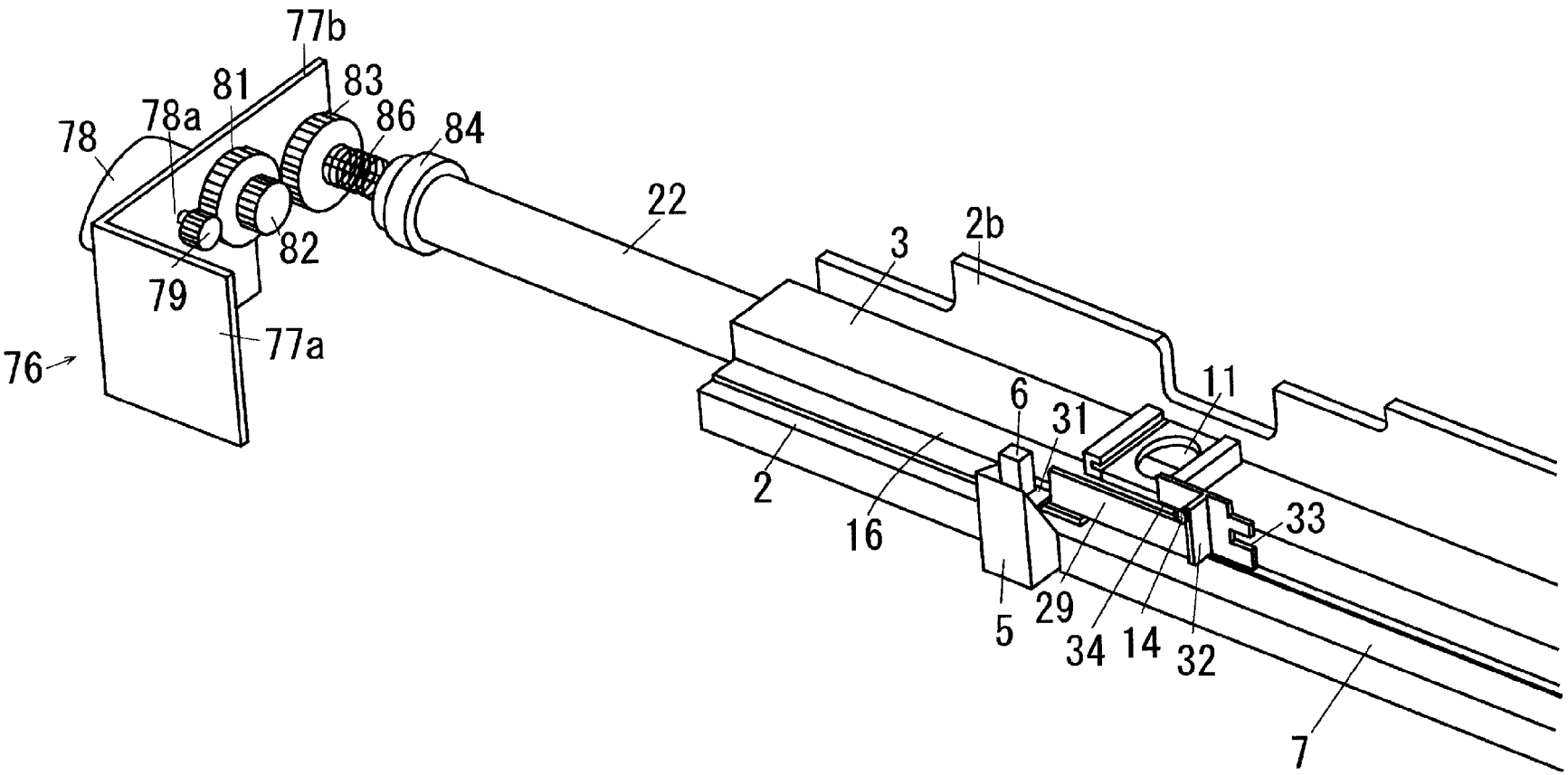
FIG. 11 is an explanatory view of a part in a state where the connection pipe of the exemplary embodiment has moved to an extracted position.

FIG. 11 is an explanatory view of a relevant part in a state where a connection pipe of the exemplary embodiment has moved to an extracted position.

A first connection gear 81 as an example of an intermediate toothed wheel, which gears with the drive gear 79, and a second connection gear 82 which is coaxially disposed with the first connection gear 81 are supported in a rotatable manner on the front side of the drive gear 79. A third connection gear 83 which gears with the second connection gear 82 is supported in a rotatable manner on a more forward side of the second connection gear 82. A coupler 84 as an example of a transmitting member, which is corresponding to the coupler 37 of the connection pipe 21, is supported in a movable manner in the axis direction and in a mutually rotatable manner with the third connection gear 83 in a left end of a rotation axis 83*a* of the third connection gear 83. As shown in FIG. 10, a concave 84*a* in which the tab 37*a* of the coupler 37 of the connection pipe 21 fits is provided on the left face of the coupler 84.

A coil spring 86 as an example of an elastic component, which energizes the coupler 84, is installed between the coupler 84 and the third connection gear 83.

In the case where the connection pipe 21 moves to the extracted position shown in FIGS. 4 to 6 and 11, when the connection motor 78 is driven in a state where the coupler 37 of the connection pipe 21 gears with the coupler 84 of the connection motor unit 76, the respective gears 79 to 83 rotate, and the relay auger 36 in the connection pipe 21 rotates via the couplers 37 and 84. By drive of the relay auger 36, the developer within the connection path 22*a* is conveyed from the pipe inlet port 23 toward the pipe outlet port 24.

As shown in FIGS. 3 and 4, collection boxes 91 and 92 as an example of a collection container are supported in a detachable manner in the box installing parts 46 and 47. The collection boxes 91 and 92 have the same configuration and are provided with collection compartments 91*a* and 92*a* for accommodating the developer therein and box ports 91*b* and 92*b*, an upper end of each of which is connected to the opening 48, respectively.

In the copying machine U of the exemplary embodiment having the configuration as described above, the developers discharged from the respective developing devices Gy to Gk at the time of forming an image, the developers collected by the respective cleaners CLy, CLm, CLc, CLk and CLB, the discharge product and the like are conveyed into the waste toner collection device UH4 through the developer dropping units UH11 to UH16, the merging conveying path UH2 and the dropping conveying path UH3. The developer which has been conveyed into the waste toner collection device UH4 flows into the connection pipe 21 and is conveyed toward the pipe outlet port 24 by the relay auger 36 rotating by drive of the connection motor 78.

The developer which has been conveyed into the pipe outlet port 24 flows out from the pipe outlet port 24 and flows into the collection conveying path 52*a* through the inlet port 52*d*. The developer within the collection conveying path 52*a* is conveyed into the first collection port 52*b* or the second collection port 52*c* by the collection auger 61 rotating depending upon the drive of the positive rotation or reverse rotation of the collection motor 68 and collected by the first collection box 91 or the second collection box 92. That is, the collection motor 68 rotates in a manner of either one of positive rotation or reverse rotation until either one of the collection box 91 or 92 has been filled; and when either one of the collection box 91 or 92 is filled, the collection motor 68 is switched to the other rotation of either one of positive rotation or reverse rotation, and the developer is collected in the other collection box 91 or 92.

Here, in the copying machine U of the exemplary embodiment, in case of installing the copying machine U or changing the installation site, the respective devices of the scanner unit U1, the sheet feeding unit U2, the main unit U3 and the sheet processing unit U4 should be detached from one another to be separately moved to improve workability in view of the weight and size as compared with the works of moving the whole at once. At that time, in the copying machine U of the exemplary embodiment, the connection pipe 21 is disposed across the main unit U3 and the sheet processing unit U4, and the connection pipe 21 enters the side of the paper process device 4.

Here, as in a conventional image forming apparatus, in the case where the connection pipe 21 is non-stretchable between the extracted position and the retracted position as in the exemplary embodiment, the sheet processing unit U4 may be taken out by drawing out it to the right relative to the main unit U3. At that time, however, the connection pipe 21 is in a state where it protrudes to the right from the right end of the main unit U3. When the works such as conveyance are carried out in this state, there is a concern that the developer leaks from the pipe outlet port 24 of the connection pipe 21. Also, the connection pipe 21 protrudes so that there is a concern that the connection pipe 21 is broken due to contact or the like at the time of conveying the main unit U3. Also, in installing the main unit U3 and the sheet processing unit U4, it is necessary to install them while registering the position of the protruded connection pipe 21. Thus, not only the works are complicated, but there is a concern that the connection pipe 21 is broken during the registration.

On the other hand, in the waste toner collection device UH4 of the exemplary embodiment, in case of separating the sheet processing unit U4 and the main unit U3 from each other, by loosening the position fixing screw 14 and operating the knob part 32 to move the connection pipe 21 from the extracted position to the retracted position, the pipe outlet port 24 and the inlet port of the bottle joint 51 are separated from each other, and the connection pipe 21 is accommodated in the main unit U3. Accordingly, the connection pipe 21 spreading over the main unit U3 and the sheet processing unit U4 is accommodated in the main unit U3 and separated from the bottle joint 51 supported in the paper process device U4. Accordingly, in the waste toner collection device UH4 in which the connection pipe 21 is accommodated in the main unit U3, breakage of the connection pipe 21 at the time of conveying the main unit U3 is reduced.

In particular, in the connection pipe 21 of the exemplary embodiment, the right end coupler 37 is accommodated in the pipe cover 1, and the connection pipe 21 is accommodated in a state where no protruded portion is present. Thus, breakage of the coupler 37 or the like is reduced.

Also, in a state where the knob part 32 is operated and moved to the retracted position, when the position fixing screw 15 is fastened, the connection pipe 21 is held at the retracted position by the position fixing screw 15. Accordingly, even when the main unit U3 is, for example, inclined during the conveyance, the connection pipe 21 does not protrude upon movement, and breakage of the connection pipe 21 or the coupler 37 is prevented from occurring.

Furthermore, the pipe inlet port 23 of the connection pipe 21 and the cover port 11 are deviated from each other at the retracted position, and the developer is in a state where it is not able to flow into the connection path 22*a*. Accordingly, leak caused due to flowing in of the developer from the dropping conveying path UH3 or the like is reduced. Also, as shown in FIG. 7D, the pipe outlet port 24 is plugged by the pipe seal 4, thereby preventing leak of the developer from the pipe outlet port 24 from occurring. Thus, flowing out of the developer from the connection pipe 21 is reduced.

Also, when connecting the main unit U3 and the sheet processing unit U4 to each other, by loosening the position fixing screw 15 and operating the knob part 32 to move it toward the extracted position from the retracted position, the connection pipe 21 enters the sheet processing unit U4 and penetrates through the pipe penetration part 59. At that time, in the case where the position of the main unit U3 is deviated from that of the sheet processing unit U4, the connection pipe 21 does not penetrate through the pipe penetration part 59 or interferes so that a worker recognizes it with ease.

In the exemplary embodiment, the pipe guide face 59*a* in which an inside diameter thereof increases toward the left is provided, and in inserting the connection pipe 21 into the pipe penetration part 59, so far as the deviation is minute, the connection pipe 21 is guided into the pipe penetration part 59 upon being guided by the pipe guide face 59*a*. Thus, works for inserting the connection pipe 21 into the pipe penetration part 59 may be executed smoothly and easily.

The movement of the connection pipe 21 to the extracted position completes when the coupler 37 of the connection pipe 21 gears with the coupler 84 of the connection motor unit 76. In this state, the extracted position fixing slit 34 fits in the right-side position fixing screw 14. Thus, when the position fixing screw 14 is fastened, the connection pipe 21 is held at the extracted position. Thus, the pipe inlet port 23 of the connection pipe 21 is connected to the cover port 11, and the pipe outlet port 24 is connected to the inlet port 52*d* of the bottle joint 51, thereby making it possible to recover the developer in the collection bottle 91 or 92.

Also, in the connection state, the plate to be detected 31 which moves integrally with the connection pipe 21 enters the position of the photo sensor 6. Accordingly, in the case where a worker forgets to move the connection pipe 21 from the retracted position to the extracted position, or the movement of the connection pipe 21 is accommodated before it moves to the extracted position, it is detected by the photo sensor 6 that the connection pipe 21 does not move to the extracted position. Accordingly, an erroneous use of the copying machine U in a state where the connection pipe 21 is not installed in the bottle joint 51 is reduced.

Furthermore, the exemplary embodiment takes a configuration in which the connection motor unit 76 is provided in the sheet processing unit U4 but not the main unit U3 into which the connection pipe 21 is accommodated, and the connection motor unit 76 does not move jointly with the connection pipe 21. Accordingly, the weight which is moved in moving the connection pipe 21 is reduced, thereby making the works easy.

While the present invention has been described in detail with reference to the exemplary embodiment, it should not be construed that the invention is limited to the aforementioned the exemplary embodiment. Various modifications can be made therein within the claimed scope of the present invention. Examples of modifications (H06) to (H06) of the exemplary embodiment are described below.

(H01) In the aforementioned the exemplary embodiment, though the copying machine as an example of the image forming apparatus is exemplified, it should not be construed that the invention is limited thereto. The image forming apparatus may be configured of, for example, a printer, a facsimile machine or a complex machine having the plural or all of these functions.

(H02) In the aforementioned the exemplary embodiment, the copying machine U is not limited to the configuration using toners of four colors but may also be applied to image forming apparatus of five colors or more, or image forming apparatus of not more than three colors or a single color.

(H03) In the aforementioned the exemplary embodiment, though it is desirable to provide the photo sensor 6 and the plate to be detected 31, these components may be omitted. Also, detection components other than the photo sensor 6, such as conventional known arbitrary sensors, for example, a contact type sensor and a magnetic sensor, may also be used.

(H04) In the aforementioned the exemplary embodiment, though the connection motor unit 76 is provided in the sheet processing unit U4, it should not be construed that the invention is limited to this configuration. The connection motor unit 76 may be provided in the main unit U3.

(H05) In the aforementioned the exemplary embodiment, though a configuration in which the scanner unit U1, the sheet feeding unit U2, the main unit U3 and the sheet processing unit U4 are separable from each other is exemplified as the image forming apparatus, it should not be construed that the invention is limited to this configuration. A configuration in which other devices which may be installed and separated are present may be employed; and reversely, an arbitrary configuration in which the scanner unit U1 and the sheet feeding unit U2 are integrated so that these devices are not separable from each other may be employed.

(H06) In the aforementioned the exemplary embodiment, though a configuration in which the connection pipe 21 extends from the main unit U3, and the bottle joint 51 is provided in the sheet processing unit U4 is employed, it should not be construed that the invention is limited to this configuration. For example, the bottle joint 51 may be provided in the sheet feeding unit U2.

The aforementioned description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer collection device comprising:

a collection unit that is supported by a first frame, the collection unit comprising:

a collection container that contains a developer to be collected;

an upstream connection part that is formed with an inlet port through which the developer flows in; and a collection conveying part that conveys the developer flown in through the inlet port toward the collection container; and a connection unit that is supported by a second frame that is detachable from the first frame, the connection unit comprising:

an upstream connection port that is connected to an upstream conveying path;

a connection conveying part that conveys the developer flown in through the upstream connection port in a developer conveying direction; and a connection outlet port that is formed at a downstream end in the developer conveying direction, wherein the connection unit is configured to be movable between an extracted position, at which the connection unit is extracted from the second frame to enter the first frame to connect the connection conveying part with the upstream connection part for connecting the connection outlet port with the inlet port, and a retracted position, at which the connection unit is retracted into the second frame to separate the connection conveying part from the upstream connection part.

2. The developer collection device according to claim 1 further comprising a movable supporting member that is fixed to the second frame and supports a downstream end of the upstream conveying path while supporting the connection unit to be movable between the extracted position and the retracted position.

3. The developer collection device according to claim 1 further comprising:

a connection conveying member that is rotatably supported within the connection conveying part;

a transmitted member that is supported by the connection conveying member;

a connection actuator that is supported by the collection unit and outputs a driving power; and a transmitting member that is connectable with the transmitted member when the connection unit is moved to the extracted position and transmits the driving power output from the connection actuator to the connection conveying member through the transmitted member.

4. The developer collection device according to claim 1 further comprising:

a detected part that is supported by the connection conveying part to move along with the connection conveying part; and a detector that is disposed at a detecting position at which the detected part is positioned when the connection conveying part is moved to the extracted position, the detector detecting presence or absence of the detected part at the detecting position.

5. An image forming apparatus comprising:

an image carrier that is configured to carry a latent image formed thereon;

a developer that is configured to develop the latent image formed on the image carrier into a visible image;

a transfer device that is configured to transfer the visible image on the image carrier onto a sheet;

a cleaner that is configured to collect a residue remaining on the image carrier after the visible image is transferred onto the sheet to clean the image carrier;

an upstream conveying path that is configured to convey the residue collected by the cleaner;

a collection unit that is supported by a first frame, the collection unit comprising:

a collection container that contains a developer to be collected;

an upstream connection part that is formed with an inlet port through which the developer flows in; and a collection conveying part that conveys the developer flown in through the inlet port toward the collection container; and a connection unit that is supported by a second frame that is detachable from the first frame, the connection unit comprising:

an upstream connection port that is connected to the upstream conveying path;

a connection conveying part that conveys the developer flown in through the upstream connection port in a developer conveying direction; and a connection outlet port that is formed at a downstream end in the developer conveying direction, wherein the connection unit is configured to be movable between an extracted position, at which the connection unit is extracted from the second frame to enter the first frame to connect the connection conveying part with the upstream connection part for connecting the connection outlet port with the inlet port, and a retracted position, at which the connection unit is retracted into the second frame to separate the connection conveying part from the upstream connection part.

* * * * *